US005368459A

United States Patent [19]

Retschnig et al.

[11] Patent Number: 5,368,459

[45] Date of Patent: Nov. 29, 1994

[54] DEVICE FOR PREPARING AND FEEDING A MONOLITHIC CERAMIC MASS INTO A METALLURGICAL MELTING VESSEL

[75] Inventors: Alexander Retschnig, Leoben; Manfred Slamenik, Trofaiach, both of Austria

[73] Assignee: Veitscher Magnesitwerke-Actien-Gesellschaft, Vienna, Austria

[21] Appl. No.: 22,672

[22] Filed: Mar. 1, 1993

[30] Foreign Application Priority Data

Mar. 5, 1992 [AT] Austria ..... A 415/92

[51] Int. Cl.[5] ..... B28B 1/08; B05B 3/12

[52] U.S. Cl. ..... 425/60; 118/317; 118/324; 249/87; 249/89; 425/98; 425/127; 425/129.1; 425/209; 425/258; 425/432; 425/447; 425/449; 425/456

[58] Field of Search ..... 425/127, 129.1, 110, 425/209, 207, 200, 580, 582, 585, 258, 376, 1, 421, 432, 456, 447, 449, 96, 98, 60; 118/317, 323; 249/90, 87

[56] References Cited

U.S. PATENT DOCUMENTS

| | | | |
|---|---|---|---|
| 2,837,910 | 6/1958 | Steed | 425/60 |
| 3,346,412 | 10/1967 | Siegenthaler et al. | 118/317 |
| 3,682,448 | 8/1972 | Kedzior et al. | 425/449 |
| 3,779,679 | 12/1973 | Bisinella et al. | 425/60 |
| 3,799,445 | 3/1974 | Marino | 118/317 |
| 3,917,170 | 11/1975 | Marino | 118/317 |
| 4,181,258 | 1/1980 | Ogawa | 118/317 |
| 4,218,050 | 8/1980 | Egli et al. | 425/60 |
| 4,421,697 | 12/1983 | Taguchi et al. | 425/60 |
| 4,560,591 | 12/1985 | Plumat et al. | 118/317 |
| 4,602,771 | 7/1986 | Milliron et al. | 425/60 |
| 4,690,327 | 9/1987 | Takai et al. | 118/317 |
| 4,908,234 | 3/1990 | Daussan et al. | 118/317 |
| 5,037,672 | 8/1991 | Daussan et al. | 118/317 |

FOREIGN PATENT DOCUMENTS

| | | | |
|---|---|---|---|
| 59-119177 | 7/1984 | Japan | 425/60 |

OTHER PUBLICATIONS

Yoshino, S., "Recent Trends in Steel Ladle Linings in Japan"; Ikabutsu Overseas, vol. 1 No. 1.

*Primary Examiner*—Khanh P. Nguyen

*Attorney, Agent, or Firm*—John F. A. Earley; John F. A. Earley, III

[57] ABSTRACT

The present invention pertains to a device for preparing and feeding a monolithic ceramic mass into a metallurgical melting vessel, including a mixer 30 and a feeding device 32, characterized in that the mixer 30 and the feeding device 32 are designed as a compact unit 28 for arrangement above the metallurgical vessel, wherein the mixer 30 and/or the feeding device 32 are arranged relative to one another and movably such that the mass prepared in the mixer 30 can be directly introduced at any desired point of the metallurgical vessel via the feeding device 32.

17 Claims, 1 Drawing Sheet

DEVICE FOR PREPARING AND FEEDING A MONOLITHIC CERAMIC MASS INTO A METALLURGICAL MELTING VESSEL

BACKGROUND OF THE INVENTION

The present invention pertains to a device for preparing and feeding a monolithic ceramic mass into a metallurgical melting vessel, comprising a mixer and a feeding device. Such a device has been known from, e.g., EP 0,326,461 B1. The (dry) mixture components of the mass are fed into a mixer from silos, mixed with water there, and fed into a spraying device, which is in the form of a lance, wherein the mass is sprayed via the lance onto the wall and the bottom of the metallurgical vessel.

The prior-art device has a relatively complicated design and a considerable outlay for the technical device is required.

A device of this class, in which preparation is carried out outside the area of the metallurgical melting vessel, has also been known from *Taikabutsu Overseas*, Vol. 1, 49, 51. The finished mass is delivered via a kind of bucket loader into the area above the ladle, which is covered with a conical top such that as soon as the bucket is opened, the mass is able to flow over the cone laterally into the annular space between a template and the inner wall of the ladle. An expensive device is required in this case as well. In addition, the material must be transported over rather long distances, which is also time-consuming.

Finally, a process for lining a metallurgical melting vessel with a monolithic coating mass has been known from practice, according to which the dry components of the mass, drawn off from silos, are mixed after adding water, and are subsequently delivered via a conveyer belt through the opening mouth of the metallurgical vessel, where they reach the area between the template and the inner wall of the metallurgical vessel in the above-described manner. The material must be transported over considerable distances in this case as well. In addition, the mass, which is already thixotropic after addition of water, must be transported over these long distances, which may lead to an uncontrollable change in the viscosity of the mass. In addition, a large amount of work and cleaning must be performed after completion of the lining.

SUMMARY OF THE INVENTION

The basic task of the present invention is therefore to show a possibility of how the preparation and the feeding of a monolithic ceramic mass into a metallurgical melting vessel can be made simpler, more efficient, and more reliable.

The present invention is based on the discovery that this goal can be accomplished especially by designing the preparation and feeding devices together in the form of a compact unit and arranging it directly above the metallurgical melting vessel. This leads immediately to the advantage that longer transport distances are eliminated. Segregation, which may occur during transport after external preparation according to the state of the art, is not to be feared, because the mass is prepared directly above the metallurgical vessel and is introduced at the intended destination in a very short time. Shorter transport distances also mean reduced cleaning costs. In addition, the viscosity of the mass can be specifically set and maintained in a defined manner over the (short) transport distance to the intended destination.

Thus, in its most general embodiment, the present invention suggests a device for preparing and feeding a monolithic ceramic mass into a metallurgical melting vessel, comprising a mixer and a feeding device, which has the following characteristics:

The mixer and the feeding device are designed as a compact unit, the compact unit is designed such that it can be arranged directly above the metallurgical vessel, wherein the mixer and/or the feeding device are arranged relative to one another and movably such that the mass prepared in the mixer can be introduced via the feeding device directly at any desired point of the metallurgical vessel.

The compact unit may be installed using a wide variety of means and methods. To guarantee a secure stationary position, the mixer should have a mounting device for attaching to a support frame. The support frame is used directly or indirectly for positioning the mixer (the compact unit) in the area of the opening mouth of the metallurgical vessel. In the case of, e.g., a (rotationally symmetrical) ladle, it is logical to design the mounting device in the manner of a rotary table, which can preferably be driven by a motor. It is particularly advantageous here for the compact unit to be rotatable around a shaft extending coaxially to the central longitudinal axis of the metallurgical vessel.

The support frame may be attached directly to the mixer (to the compact unit). It is now possible to arrange the support frame itself at a template that can be inserted at a spaced location from the wall of the metallurgical vessel, so that the template and the compact unit can be introduced together into, e.g., a ladle before the latter is lined. This embodiment is particularly favorable if there is a plurality of metallurgical vessels of the same design at the same plant.

However, it is also possible to attach the compact unit to any other type of support frame. The support frame may be in the form of, e.g., a stand, which is either erected on the bottom of the ladle or extends over the entire ladle.

Finally, it is also conceivable that the compact unit is suspended on a support frame rather than being mounted on a support frame. For example, crane systems, on which a device according to the present invention can be suspended without any problem and can be positioned above a metallurgical melting vessel, are available in steel mills and foundries.

The mixer itself may be a positive mixer, which is provided with, e.g., a mixing and feed screw, via which the prepared mass is forcibly transported via the feeding device and is introduced behind a template into the annular area between the template and the wall of the metallurgical melting vessel. In the case of such a forced mixing or such a forced delivery, the feeding device may extend horizontally without any problem.

However, it is also possible to design the feeding device as an inclined device (in the direction of the bottom of the metallurgical vessel) starting from the mixer, and it is particularly advantageous in this embodiment to design the feeding device in the form of, e.g., a vibrating chute, which also ensures that the viscosity of the mass flow will remain relatively low, thus making it possible to completely fill the space between the template and the wall of the metallurgical vessel.

To make it possible to use the device also for lining metallurgical melting vessels of different sizes (different diameters), the feeding device is designed as a longitudinally adjustable feeding device according to an advantageous embodiment of the present invention. The feeding device is preferably designed in this case as a telescoping feeding device, so that the filling head at the free end of the feeding device can be brought to the desired position. The feeding head may be designed as a head inclined in the downward direction, in the direction of the bottom of the metallurgical vessel, so that the mass flow is introduced vertically into the annular space between the template and the wall of the metallurgical vessel.

The device must, of course, be designed with a feeding device for a liquid. This is achieved in the simplest case by a water line leading into the feeding elements for the (dry) mixture components. The homogeneity of the vibration mass, which is prepared in the mixer and is usually thixotropic, can be additionally increased by the water feed line leading directly into the mixing chamber. It may be detachably connected there.

In one embodiment of the present invention, a funnel-shaped hopper is arranged above the mixer for feeding in the dry mixture components. Filling can now be carried out via so-called big bags, but also in another, prior-art manner, e.g., via feed belts.

The essential advantage of the device is the fact that the mixture components (including the mixing water and additives, if any, as well as aggregates) are charged directly into the mixer, and the mixer in turn is arranged directly above the metallurgical vessel, so that segregation phenomena are ruled out. The dry starting material enters the mixing chamber in a very short distance, is mixed with water there, and is fed to its destination after homogenization over a very short distance. It can be immediately recognized that the device, being a compact unit, requires a low cost for the apparatus, and the amount of cleaning operations is also markedly reduced compared with prior-art devices. In addition, the device is easy to transport and can be used for a great variety of metallurgical vessels of greatly different sizes.

Thus, it is, of course, also possible to charge a coating composition into metallurgical vessels with asymmetric geometry via the device. This requires only controlling the position of the feeding device, which is adjustable (over its length), wherein this control is possibly programmable via a computer unit.

Further characteristics of the present invention will become apparent from the characteristics of the subclaims and the other application documents.

BRIEF DESCRIPTION OF THE DRAWINGS

The present invention will be explained in greater detail below on the basis of an exemplary embodiment. In highly schematic representations, the drawing shows.

DETAILED DESCRIPTION

Figure 1:
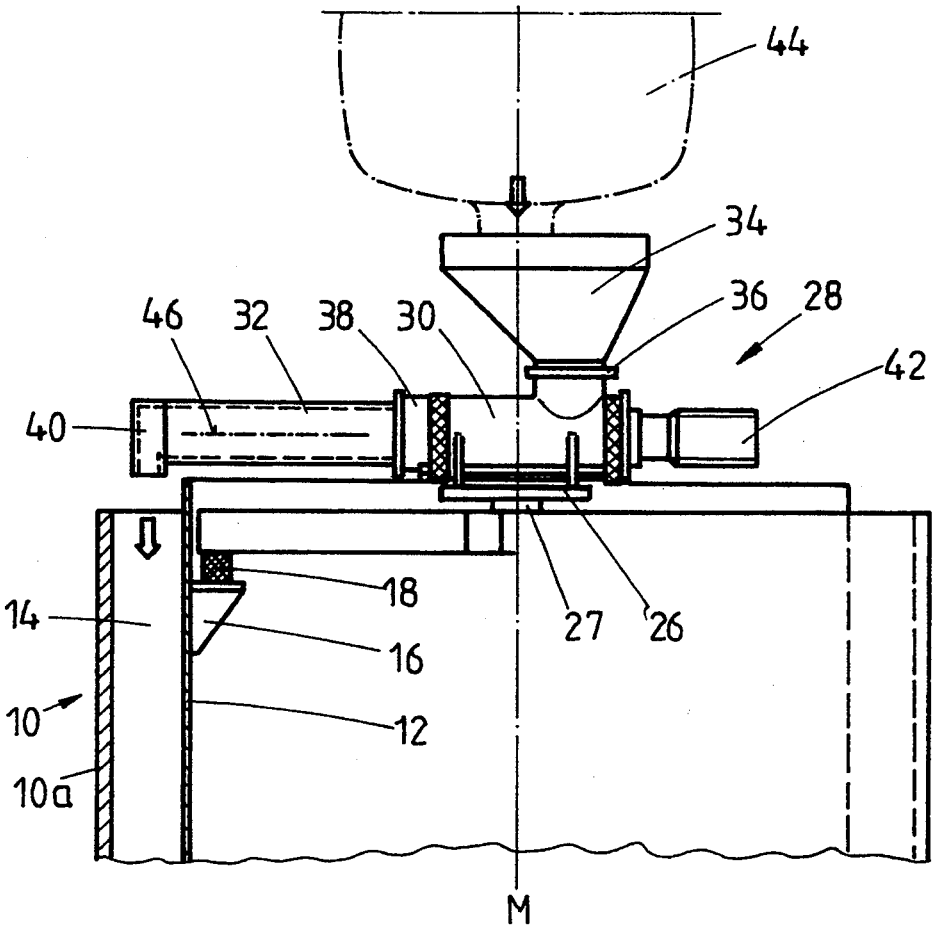
FIG. 1: a (partially cutaway) representation of a device according to the present invention, associated with a ladle
Figure 2:
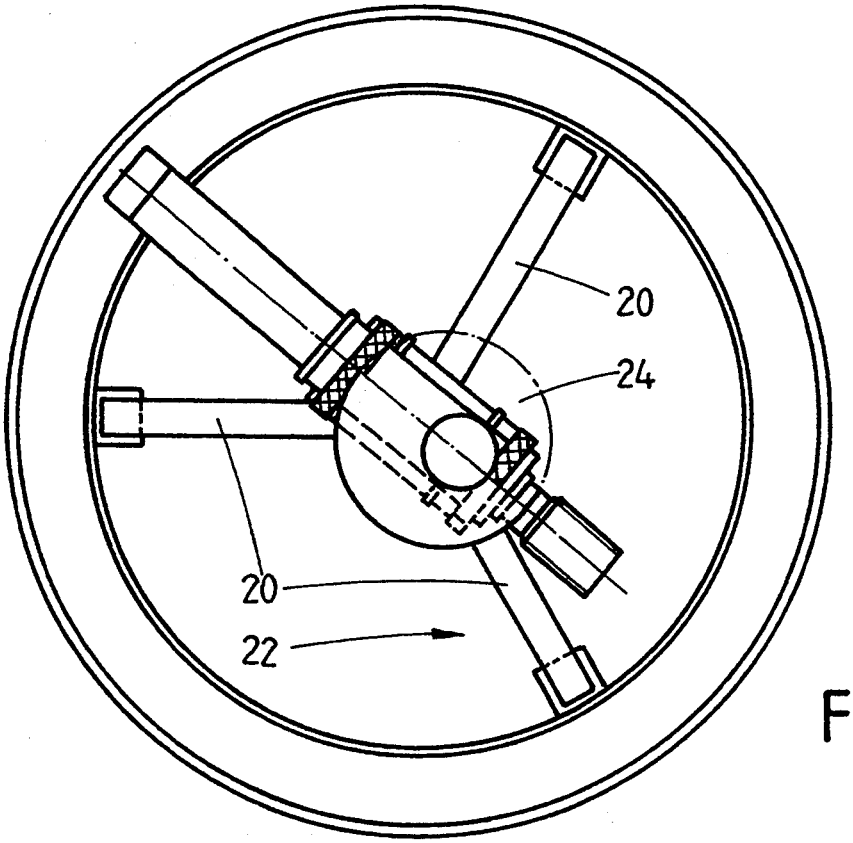
FIG. 2: a top view of the device according to FIG. 1.

FIGS. 1 and 2 show the top section of a ladle 10, which has a circular cross section.

A (prior-art) template 12, which stands on the bottom of the said ladle 10 (not shown), extends at a spaced location from the wall 10*a* of the said ladle 10.

An annular space 14, which is to be filled with a thixotropic ceramic vibration mass here, is thus formed between the said wall 10*a* of the said ladle 10 and the said template 12.

At its top end, the said template 12 has projections 16 on the inside, on which vibration-and noise-absorbing bodies 18 made of a deformable material are located.

The said bodies 18 are intended to support arms 20, of which there are a total of three here, of a support frame, which is designated as a whole by the reference numeral 22, wherein the said arms 20 extend in a star-shaped pattern relative to one another and are centrally hinged to a plate 24.

A shaft 27, on which a rotary table 26 is located, extends from the said plate 24 vertically in the upward direction. The said rotary table is driven by a motor, but the drive unit is not shown here for the sake of greater clarity.

A compact unit 28, which comprises a mixer 30, a feeding device 32, and a feed hopper 34, is attached to the said rotary table 26. The said receiving hopper 34 is designed as an asymmetric hopper, and opens into a connection piece 36 in the top section of the said mixer 30.

The said feeding device 32 extends from a lateral discharge area 38 of the said mixer 30 and extends essentially horizontally and radially to the central longitudinal axis M of the said ladle 10 and into the area above the said annular space 14, where a filling head 40, which is open in the downward direction, is connected to the said feeding device 32.

Finally, at the end of the said mixer 30 located opposite the said discharge area 38, a feeding device 42 for a water connection (not shown) is provided.

The mode of operation of the device is as follows:

The (dry) mixture components of the vibration mass, supplemented with additives and aggregates if desired, are charged—if desired, as a finished dry mixture—into the said hopper 34. This can be done in a particularly simple manner by using so-called big bags. Such a big bag is symbolically represented by reference numeral 44 in FIG. 1. Via the said hopper 34, the dry mixture enters the area of the said mixer 30, where mixing water is added.

The said mixer 30 is designed as a positive mixer here, and thus it comprises a feed screw 46 (symbolically represented by reference numeral 46), which extends over the said discharge area 38 through the said tubular feeding device 32 and into the area of the said filling head 40.

The mixed vibrated mass is transported along the said feed screw to the said filling head 40, and it enters from there into the said annular space 14 in the downward direction.

As is apparent from FIG. 2, the said compact unit 28 is rotated by a total of 320° by means of the said motor-driven rotary table 26 during the lining process, so that the said annular space 14 can gradually be filled completely with the said vibration mass.

Uniform filling of the said annular space 14 with the thixotropic vibration mass, which was prepared practically immediately before, is thus achieved. Due to the fact that the said filling head 40 extends directly above the said annular space 14, there is no longer a risk of contamination of the surroundings, because the vibration mass is filled purposefully into the said annular space. The use of the device described also ensures that the filling process will not be hindered, because, e.g., the connected water line rotates together [with the unit].

As was described above, it is also possible to design the said feeding device 32 as a telescoping device, so that its length can be varied in order to be adapted to metallurgical vessels of different geometries. It is also possible to design the said feeding device 32 as an inclined device. Instead of forced feed of the vibration mass via a feed screw, transport can also be ensured by designing the said feeding device as a vibrating chute.

We claim:

1. Device for preparing and feeding a monolithic ceramic mass into an annular space formed between an inner wall of a metallurgical melting vessel and a template, extending at a spaced location from said wall, comprising a mixer and a feeding device, wherein the mixer and the feeding device are arranged movably and one next to the other as a compact unit said compact unit being arranged on a support frame for positioning the compact unit above the metallurgical vessel, such that the mass prepared in the mixer is directly introduced at any desired point of the metallurgical vessel via the feeding device into said annular space.

2. Device in accordance with claim 1, wherein the mixer (30) has a mounting device (26) for attachment to a support frame (22).

3. Device in accordance with claim 2, wherein the mounting device (26) comprises a rotary table.

4. Device in accordance with claim 2, wherein the mounting device is driven by a motor.

5. Device in accordance with claim 1, wherein the compact unit (28) is rotatable around a shaft (27) extending coaxially to the central longitudinal axis (M) of the metallurgical vessel.

6. Device in accordance with claim 2, wherein the support frame (22) is connected to the compact unit (28).

7. Device in accordance with claim 2, wherein the support frame is hinged to a template that is introduced at a spaced location from the wall of the metallurgical vessel.

8. Device in accordance with claim 1, wherein the feeding device is longitudinally adjustable.

9. Device in accordance with claim 8, wherein the feeding device is telescopicable.

10. Device in accordance with claim 1, wherein the feeding device (32) comprises a vibrating chute.

11. Device in accordance with claim 1, wherein at the discharge-side, free end, the feeding device (32) has a filling head (40) directed downward in the direction of the bottom of the metallurgical vessel.

12. Device in accordance with claim 1, wherein the mixer (30) is provided with a connection line (42) for supplying a liquid.

13. Device in accordance with claim 1, wherein the mixer (30) has a funnel-shaped filling device (34).

14. Device in accordance with claim 13, wherein the filling device is asymmetrical.

15. Device in accordance with claim 3, wherein the axis of rotation of the rotary table (26) is asymmetrical to the central longitudinal axis (M) of the metallurgical vessel.

16. Device in accordance with claim 1, wherein the mixer (30) is a positive mixer.

17. Device for preparing and feeding a monolithic ceramic mass into an annular space formed between an inner wall of a metallurgical melting vessel and a template, extending at a spaced location from said wall, comprising a mixer and a feeding device, wherein the mixer and the feeding device are arranged movably and one next to the other as a compact unit, said compact unit being arranged on a support frame for positioning the compact unit above the metallurgical vessel, such that the mass prepared in the mixer is directly introduced at any desired point of the metallurgical vessel via the feeding device into said annular space, wherein the mixer has a mounting device for attachment to a support frame, wherein the mounting device consists of a rotary table, wherein the mounting device is motor driven, wherein the compact unit is rotatable around a shaft extending coaxially to the central longitudinal axis (M) of the metallurgical vessel, wherein the support frame is connected to the compact unit, wherein the support frame is hinged to the template that is introduced at a spaced location from the wall of the metallurgical vessel, wherein the feeding device consists of a telescopic vibrating chute, wherein at the discharge-side, free end, the feeding device has a filling head directed downward in the direction of the bottom of the metallurgical vessel, wherein the mixer is provided with a connection line for supplying a liquid, wherein the mixer has a funnel-shaped filling device, wherein the filling device is asymmetrical, wherein the axis of rotation of the rotary table is asymmetrical to the central longitudinal axis (M) of the metallurgical vessel, and wherein the mixer is a positive mixer.

* * * * *